US008201698B2

(12) United States Patent
Moffly

(10) Patent No.: US 8,201,698 B2
(45) Date of Patent: Jun. 19, 2012

(54) ENHANCED BOTTLE RACK

(75) Inventor: John Moffly, San Francisco, CA (US)

(73) Assignee: Latticestix, Inc., San Francisco, CA (US)

( * ) Notice: Subject to any disclaimer, the term of this patent is extended or adjusted under 35 U.S.C. 154(b) by 0 days.

(21) Appl. No.: 12/780,894

(22) Filed: May 15, 2010

(65) Prior Publication Data

US 2011/0278247 A1 Nov. 17, 2011

(51) Int. Cl.
*A47B 73/00* (2006.01)

(52) U.S. Cl. ..... 211/74

(58) Field of Classification Search ..... 211/74, 211/75, 194, 188, 195, 60.1, 77, 70.3, 44, 211/70.8, 70.2, 62, 65, 85.18; 206/196, 201, 206/203, 427; 52/DIG. 2; D06/462, 455; D07/619.1

See application file for complete search history.

(56) References Cited

U.S. PATENT DOCUMENTS

| | | | | | |
|---|---|---|---|---|---|
| 1,151,974 | A | * | 8/1915 | Straight | 256/19 |
| 1,193,980 | A | * | 8/1916 | Bowen | 220/514 |
| 2,755,923 | A | * | 7/1956 | Guilleminot et al. | 206/427 |
| 3,023,908 | A | * | 3/1962 | Ramey | 211/74 |
| 3,160,278 | A | * | 12/1964 | Varkala | 211/74 |
| 3,306,463 | A | * | 2/1967 | Maslow | 211/41.2 |
| 3,480,152 | A | * | 11/1969 | Walsh | 211/74 |
| 3,870,155 | A | * | 3/1975 | Galloway | 211/74 |
| 4,341,308 | A | * | 7/1982 | Pasquini | 206/427 |
| 4,446,972 | A | * | 5/1984 | Sussman | 211/26 |
| D275,626 | S | * | 9/1984 | Moore | D7/708 |
| 4,700,837 | A | * | 10/1987 | Hammett | 206/427 |
| 4,715,503 | A | * | 12/1987 | Johnson | 211/74 |
| 4,795,038 | A | * | 1/1989 | Johnson | 211/74 |
| 4,911,300 | A | * | 3/1990 | Colonna | 206/427 |
| 5,025,936 | A | * | 6/1991 | Lamoureaux | 211/74 |
| 5,071,006 | A | * | 12/1991 | Neace, Jr. | 206/427 |
| D323,600 | S | * | 2/1992 | Patke | D7/704 |
| 5,143,283 | A | * | 9/1992 | Lancaster | 229/199 |
| 5,263,605 | A | * | 11/1993 | Caton | 220/519 |
| 5,377,850 | A | * | 1/1995 | Liaw | 211/163 |
| D376,299 | S | * | 12/1996 | Audet | D7/704 |
| 5,673,792 | A | * | 10/1997 | Aikio | 206/509 |
| 5,826,712 | A | * | 10/1998 | Aikio | 206/203 |
| 5,918,751 | A | * | 7/1999 | Kelly | 211/194 |
| 5,947,305 | A | * | 9/1999 | Lin | 211/74 |
| 6,102,217 | A | * | 8/2000 | Mathy et al. | 211/85.7 |
| 6,527,116 | B1 | * | 3/2003 | Gale | 206/427 |
| 6,726,031 | B2 | * | 4/2004 | Laupan | 211/41.8 |

(Continued)

FOREIGN PATENT DOCUMENTS

FR 2615085 A1 * 11/1988

(Continued)

*Primary Examiner* — Darnell Jayne
*Assistant Examiner* — Hiwot Tefera
(74) *Attorney, Agent, or Firm* — Mahamedi Paradice Kreisman LLP; Zurvan Mahamedi

(57) ABSTRACT

A bottle rack with opposing panels connected by rods or other connection structures to compactly support bottles is provided. Each panel includes a plurality of structures that are geometrically arranged to form a combination of large openings and small openings. Each large opening is positioned adjacent to a small opening. For adjacent pairs of large-small openings, the plurality of segments include (A) a first tangent structure that is (i) tangential to both the large and small opening, (ii) positioned on a same side of the two openings, and (B) a second tangent structure that is (i) tangential to both the large and small opening, and (ii) positioned in between the large and small opening.

15 Claims, 4 Drawing Sheets

U.S. PATENT DOCUMENTS

| | | | | |
|---|---|---|---|---|
| 6,877,604 | B2 * | 4/2005 | Pratt et al. | 206/315.6 |
| 6,935,515 | B1 * | 8/2005 | Sookoo | 211/65 |
| D525,091 | S * | 7/2006 | Baxter et al. | D7/701 |
| D528,381 | S * | 9/2006 | Clark | D7/704 |
| 7,131,544 | B1 * | 11/2006 | Cunningham | 211/74 |
| 7,237,675 | B2 * | 7/2007 | O'Malley | 206/433 |
| 7,665,270 | B1 * | 2/2010 | Moffly | 52/668 |
| 2001/0025824 | A1 * | 10/2001 | Olivero | 211/74 |
| 2003/0178381 | A1 * | 9/2003 | Liang | 211/74 |
| 2004/0074792 | A1 * | 4/2004 | Pratt et al. | 206/315.6 |
| 2005/0236288 | A1 * | 10/2005 | Anderson et al. | 206/315.6 |
| 2005/0263471 | A1 * | 12/2005 | Schmidt | 211/183 |
| 2005/0274639 | A1 * | 12/2005 | Meissen | 206/427 |
| 2006/0032411 | A1 * | 2/2006 | Hummel et al. | 108/53.3 |
| 2007/0108144 | A1 * | 5/2007 | Flick | 211/74 |
| 2007/0108145 | A1 * | 5/2007 | Milardo et al. | 211/74 |
| 2007/0241008 | A1 * | 10/2007 | Weavind | 206/315.6 |
| 2008/0110784 | A1 * | 5/2008 | Nowicki | 206/446 |
| 2011/0049068 | A1 * | 3/2011 | Potter | 211/69.1 |

FOREIGN PATENT DOCUMENTS

| | | | |
|---|---|---|---|
| JP | 11351737 | A * | 12/1999 |

* cited by examiner

ENHANCED BOTTLE RACK

TECHNICAL FIELD

The disclosed embodiments relate to an enhanced bottle rack.

DETAILED DESCRIPTION

Embodiments described herein provide an enhanced bottle rack, such as used for holding wine bottles and bottles with extended necks.

Embodiments described herein provide for a bottle rack that is comprised of opposing panels. Each panel is comprised of a plurality of segments that are geometrically arranged to form an opening configuration in which a large opening (suitable for retaining base end of a bottle) is positioned adjacent to a small opening (suitable for retaining a neck of a bottle). The two panels are arranged parallel to each other such that each of the small openings on the first panel shares a center line with a large opening on the second panel, and each of the large openings on the first panel share a centerline with a small opening on the second panel.

According to some embodiments, for segments that form an adjacent pair of large-small openings, the individual segments include (A) a first tangent structure that is (i) tangential to both the large and small opening, (ii) positioned on a same side of the two openings, and (B) a second tangent structure that (i) tangential to both the large and small opening, and (ii) positioned in between the large and small opening. The result is that each large opening on the first panel is axially aligned with a corresponding small opening on the second panel. Likewise, each large opening on the second panel is axially aligned with a corresponding small opening on the first panel.

Among other benefits, a bottle rack such as described herein enables bottles to be racked in a configuration that is more dense than conventional approaches.

Figure 1A:
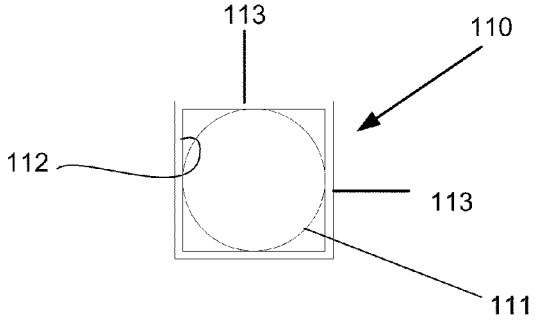
FIG. 1A and FIG. 1B illustrate segments that forms a portion of a panel, according to an embodiment.
Figure 1B:
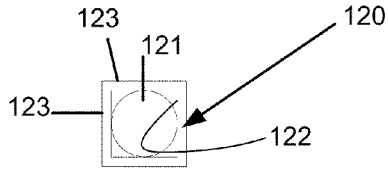

FIG. 1A and FIG. 1B illustrate segments that forms a portion of a panel, according to an embodiment. In FIG. 1A, a segment 110 defines a large opening 112 that can retain a base of a bottle. In FIG. 1B, a segment 120 defines a small opening 122 that holds the neck or end of a bottle. The respective base and neck of the bottle is less than a diameter of a reference circle 111, 121 that can be said to occupy each segment 110, 120. While the openings 112, 122 are shown to be square, the openings can alternatively be another geometric shape, such as rectangular, circular, or oval.

In an embodiment shown, segments 110, 120 define respective openings 112, 122 by structures 113, 123. The structures 113A, 123 may correspond to linear members, such as rods, members, blocks, or lattice sticks. The structures 113, 123 may be referenced as tangents to the reference circle 111, 121.

Figure 1C:
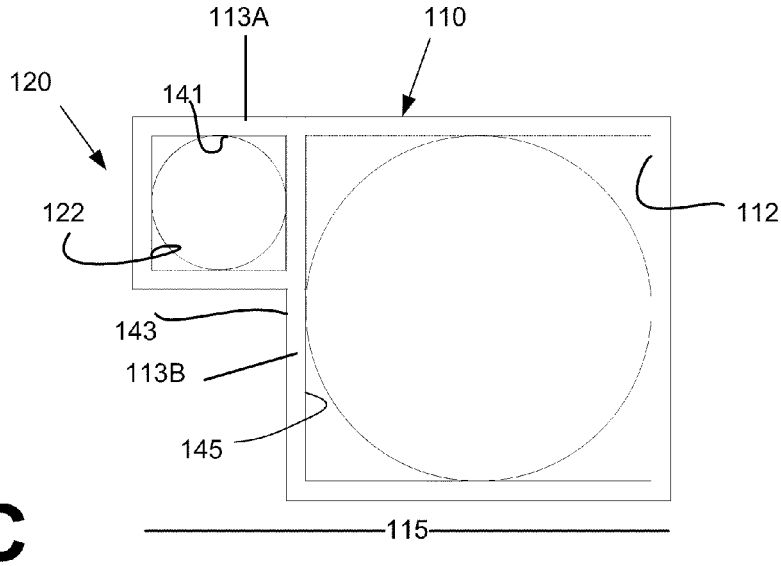
FIG. 1C illustrates an arrangement of adjacent segments for a panel of a bottle rack, under an embodiment.

With reference to FIG. 1C, the segments 110, 120 are arranged adjacent to one another on a panel to form a large/small opening configuration 115. As a result of the large/small opening configuration 115, one panel is able to use the large opening 112 to support a bottle base and the small opening 122 to support a bottle neck. Such a configuration enables two adjacent bottles that are held in the rack to be positioned adjacent to one another, in a tightly spaced configuration. In an embodiment, the large/small opening configuration provides the following geometric relationship: (i) the openings 112, 122 are on a same side 141 of a first tangent structure 113 that is a tangent to both openings; (ii) the openings 110, 120 are on an oppose side 143, 145 of a second tangent structure 113B that is a tangent to both openings.

Figure 2A:
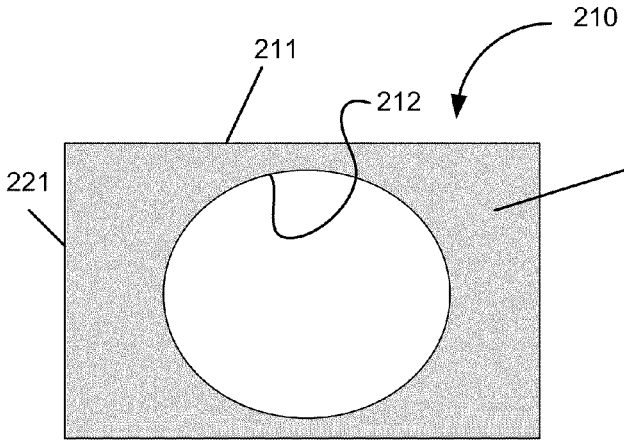
FIG. 2A and FIG. 2B illustrate an alternative segment portion of a panel, under another embodiment.
Figure 2B:
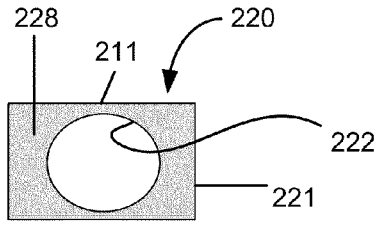

In other variations such as shown in FIG. 2A and FIG. 2B, the segments 110, 120 (see FIG. 1A through FIG. 1C) may correspond to paneled segments 210, 220 that have cut-outs as openings 212, 222. The paneled segments 210, 220 have an interior thickness 218, 228 that extends from respective lateral edges 211, 221 to a perimeter of the opening 212, 222. The openings 212, 222 are shown as oval, but can be of another geometric shape (e.g. square, rectangular, circular). The lateral edges 211, 221 provide tangents to the openings 212, 222.

Figure 2C:
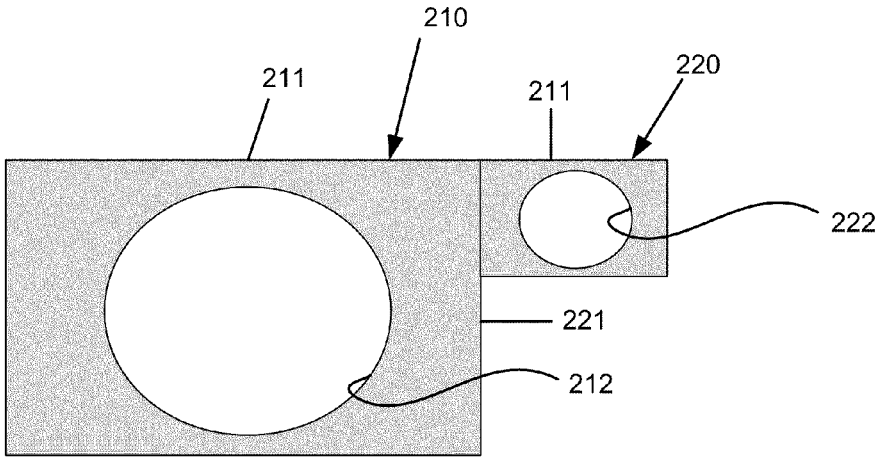
FIG. 2C illustrates a large/small opening configuration formed from panels such as described with an embodiment of FIG. 2A and FIG. 2B.

FIG. 2C illustrates a large/small opening configuration formed from panels such as described with an embodiment of FIG. 2A and FIG. 2B. As shown with FIG. 2C, the paneled segments 210, 220 can be structured to provide that (i) the openings 212, 222 are on a same side of a first tangent structure 211 that is a tangent to both openings; (ii) the openings 212, 222 are on an oppose side of a second tangent structure 221 that is a tangent to both openings 212, 222.

Figure 3A:
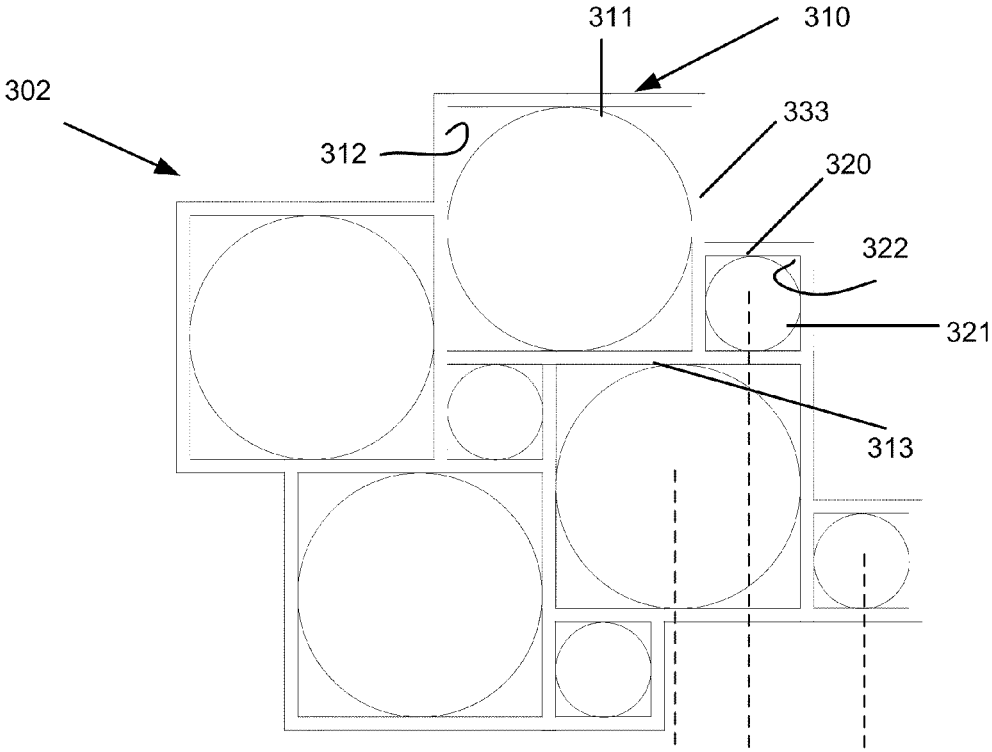
FIG. 3A and FIG. 3B illustrate panel segments that can be replicated on a panel to provide a series of adjacent large/small openings, under an embodiment.
Figure 3B:
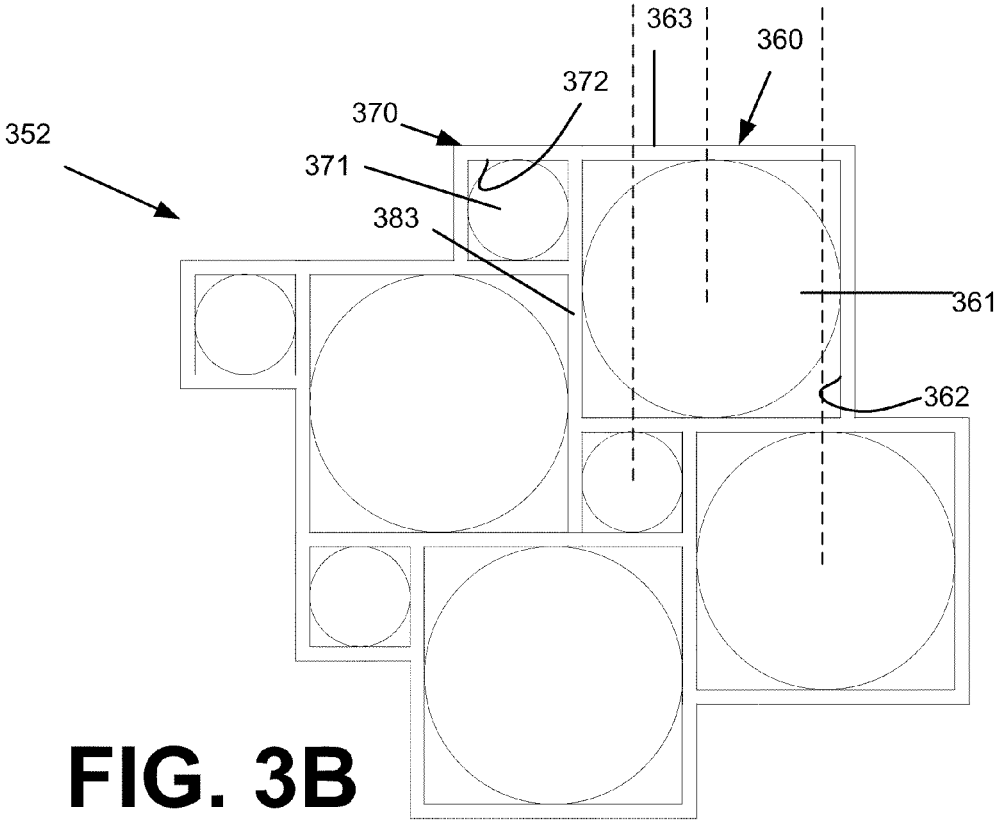

FIG. 3A and FIG. 3B illustrate panel segments that can be replicated on a panel to provide a series of adjacent large/small openings, under an embodiment. With reference to FIG. 3A, a first panel 302 comprises a plurality of segments that provides a first set of openings. The segments 310, 320 exemplify other segments that comprise the panel 302. In the example shown, the segments 310, 320 are formed by rods or linear members, and include square shaped openings. Variations to such an embodiment may include, for example, panels (e.g. see an embodiment of FIG. 2A and FIG. 2B), as well as alternative shaped openings (e.g. circle, oval, rectangle).

The segments 310, 320 illustrate a large/small opening configuration with adjacent large/small openings 312, 322. Respective reference circles 311, 321 may define a maximum area that can be occupied by an end of an inserted bottle. The adjacent large/small openings 312, 322 have the following geometric relationship: (i) the openings 312, 322 are on a same side of a first tangent structure 313 that is shared by both openings, (ii) the openings 312, 322 are on an opposite side of a second tangent structure 333 that is shared by both openings. Each panel 302, 352 can include structures that provide multiple large/small opening configurations.

With reference to FIG. 3B, a second panel 352 comprises a plurality of segments, as exemplified by segments 360, 370. The second panel 352 includes segments that are comprised of structures that form large/small opening configurations. The large/small openings are aligned with corresponding small/large openings of the first panel 302. The openings of the first panel 302 align with openings of the second panel 352 in order to support an inserted bottle from both sides. Accordingly, the segments 360, 370 provide adjacent large/small openings 362, 372. Respective reference circles 361, 371 define a maximum area that can be occupied by an end of an inserted bottle. The adjacent large/small openings 362, 372 have the following geometric relationship: (i) the openings 362, 372 are on a same side of a first tangent structure 363 that is shared by both openings, (ii) the openings 362, 372 are on an opposite side of a second tangent structure 383 that is shared by both openings.

With reference to an embodiment of FIG. 3A and FIG. 3B, the panels 302 and 352 align so that the center of each large opening in the first panel aligns with a center of a corresponding small opening 372 in the second panel. Likewise, the center of each large opening 362 in the second panel 352 aligns with a corresponding small opening 322 in the first panel 352.

According to one embodiment, the arrangement of openings results in the first panel 302 and second panel 352 include an arrangement of openings that are the same, but opposite in orientation. For example, the arrangement of openings in FIG. 3B is the same as that of FIG. 3A when rotated 180 degrees.

Figure 4:
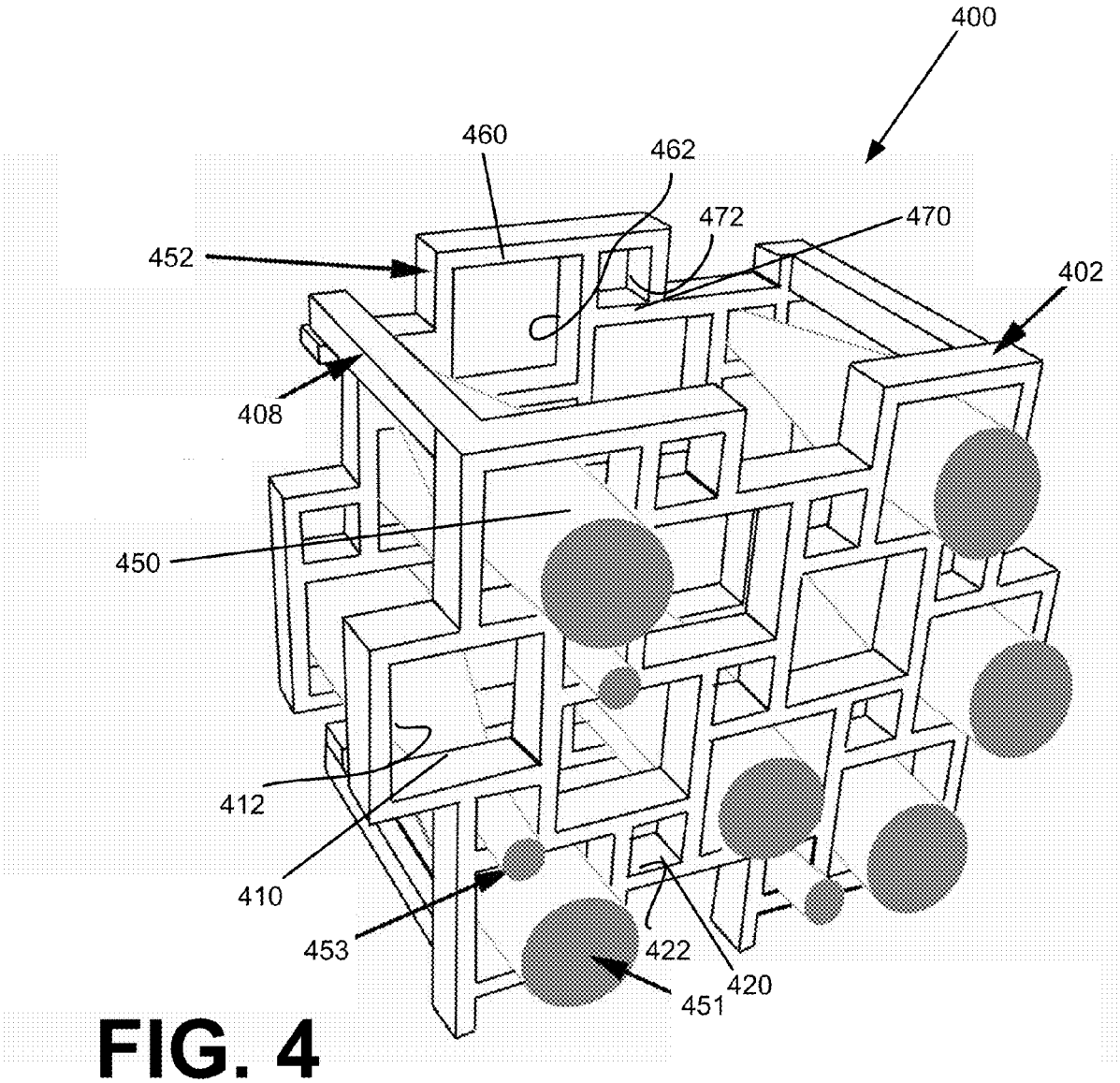
FIG. 4 is an isometric view of a wine rack, in accordance with one or more embodiments described.

FIG. 4 is an isometric view of a wine rack, in accordance with one or more embodiments described. In FIG. 4, rack assembly 400 includes a first panel 402 and second panel 452 are arranged similar to embodiments such as described with FIG. 1A through FIG. 1C, as well as FIG. 3A and FIG. 3B. The first panel 402 and second panel 452 may be joined by support structures 408. The first panel 402 includes segments 410 for large openings 412, positioned adjacent to segments 420 for small openings 422. The second panel 452 includes segments 460 for large openings 462, positioned adjacent to segments 470 for small openings 472. As mentioned above, the center of individual large openings 412 in the first panel 402 is axially aligned with a center of corresponding small openings 472 in the second panel 452. Likewise, a center of individual large openings 462 in the second panel 452 is axially aligned with a center of corresponding small openings 422 in the first panel 402.

The aligned openings serve to hold bottles 450, depicted as wine bottles. Each wine bottle 450 is inserted so that its base end 451 is retained in one of the large openings of either panel, while its neck 453 is retained in the corresponding small opening of the other panel.

Figure 5:
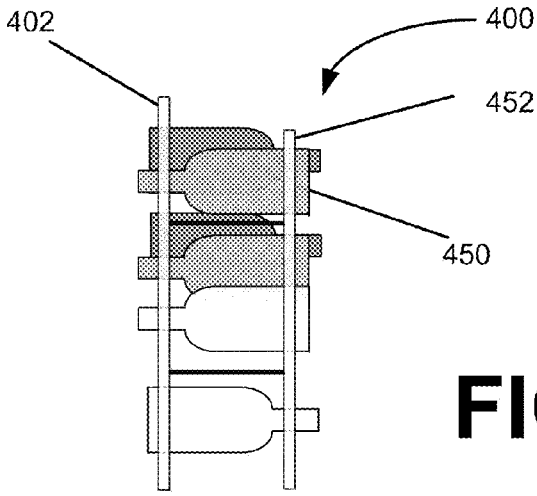
FIG. 5 illustrates a side view of a bottle rack such as shown with an embodiment of FIG. 4, under an embodiment.

FIG. 5 illustrates a side view of a bottle rack such as shown with an embodiment of FIG. 4, under an embodiment. As shown, the panels 402, 452 of bottle rack 400 are horizontally aligned, so that individual bottles 450 may extend horizontally with the ground plane. The configuration by which individual panels replicate the arrangement of adjacent large/small openings enables bottles 450 to be placed in alternating fashion, so that some bottles are extended base-to-neck in one horizontal direction, and other bottles are extended in the other direction. The number of bottles that can be retained for a given bottle rack dimension is greater than a conventional bottle rack structure.

In other embodiments, however, the bottle rack may support the bottles 450 in a tilted configuration. Thus, the axial alignment of the large/small openings in the respective panels may be skewed with respect to the vertical axis to permit the bottles to be tilted when retained.

Although illustrative embodiments have been described in detail herein with reference to the accompanying drawings, variations to specific embodiments and details are encompassed by this disclosure. It is intended that the scope of the invention is defined by the following claims and their equivalents. Furthermore, it is contemplated that a particular feature described, either individually or as part of an embodiment, can be combined with other individually described features, or parts of other embodiments. Thus, absence of describing combinations should not preclude the inventor(s) from claiming rights to such combinations.

What is claimed is:

1. A bottle rack comprising:

a first panel;

a second panel that opposes the first panel;

each of the first panel and the second panel comprising:

a plurality of segments that form (i) one or more large openings that each dimensioned to accommodate a base end of a bottle, and (ii) one or more small openings that are each dimensioned to accommodate a neck or tip end of the bottle;

wherein the plurality of segments include a large/small opening configuration that provides a first large opening adjacent to a first small opening, wherein the large/small opening configuration includes a first tangential structure that is (i) tangential to the first large opening and to the first small opening, and (ii) positioned on a same side of the first large opening and the first small opening;

wherein the large/small opening configuration further includes a second tangential structure that is (i) tangential to the first large opening, to the first small opening, and to a second large opening, (ii) positioned in between the first large opening and the first small opening, and (iii) positioned in between the first large opening and the second large opening;

wherein the large/small opening configuration further includes a third tangential structure that is (i) tangential to the first small opening and the second large opening, and (ii) positioned in between the first small opening and the second large opening;

wherein the first large opening on the first panel is axially aligned with a corresponding small opening on the second panel;

wherein the first small opening on the first panel is axially aligned with a corresponding large opening on the second panel.

2. The bottle rack of claim 1, wherein the plurality of segments of each panel include multiple large/small opening configurations that collectively include multiple (i) large openings, (ii) small openings, and (iii) first, second, and third tangential structures.

3. The bottle rack of claim 1, wherein the plurality of segments include segments formed by one or more rods or linear members.

4. The bottle rack of claim 1, wherein the first and second tangential structure comprises a rod.

5. The bottle rack of claim 1, wherein the first opening is square shaped and has a dimension that is greater than a diameter of a base of a bottle.

6. The bottle rack of claim 1, wherein the second opening is square shaped and has a dimension that is greater than a neck or tip of a bottle.

7. The bottle rack of claim 1, wherein the first opening and the second opening are each circular.

8. The bottle rack of claim 1, wherein the first opening and the second opening are each circular and formed in a square or rectangular panel.

9. The bottle rack of claim 1, wherein the first opening is circular and has a dimension that is greater than a diameter of a base of a bottle.

10. The bottle rack of claim 1, wherein the second opening is circular and has a dimension that is greater than a neck or tip of a bottle.

11. The bottle rack of claim 1, wherein the first panel and the second panel are aligned so that the first large opening receives a base of a bottle and the corresponding small opening on the second panel receives a neck of the bottle so that the bottle is positioned horizontally with respect to a ground plane.

12. The bottle rack of claim 1, further comprising a support member to connect the first panel and the second panel.

13. The bottle rack of claim 1, wherein at least some of the plurality of segments of each of the first panel and second panel include an interior thickness that circumvents a corresponding large or small opening.

14. The bottle rack of claim 13, wherein the first tangential structure and the second tangential structure are each linear members or edges of the individual segments that include the interior thickness.

15. The bottle rack of claim 13, wherein the corresponding large or small opening is circular or oval, and wherein the interior thickness is shaped to provide the large or small opening as a cut-out.

* * * * *